US006012983A

United States Patent [19]

Walker et al.

[11] Patent Number: 6,012,983

[45] Date of Patent: Jan. 11, 2000

[54] AUTOMATED PLAY GAMING DEVICE

[75] Inventors: Jay S. Walker, Ridgefield; James A. Jorasch, Stamford; Thomas M. Sparico, Riverside, all of Conn.

[73] Assignee: Walker Asset Management Limited Partnership, Stamford, Conn.

[21] Appl. No.: 08/774,487

[22] Filed: Dec. 30, 1996

[51] Int. Cl.[7] ..... A63B 71/00

[52] U.S. Cl. ..... 463/20

[58] Field of Search ..... 463/16, 20, 17; 273/292, 293, 143 R

[56] References Cited

U.S. PATENT DOCUMENTS

| | | | |
|---|---|---|---|
| 4,467,424 | 8/1984 | Hedges et al. . | |
| 4,764,666 | 8/1988 | Bergeron | 463/17 |
| 4,880,237 | 11/1989 | Kishishita | 463/20 |
| 5,401,024 | 3/1995 | Simunek . | |
| 5,429,361 | 7/1995 | Raven . | |
| 5,551,692 | 9/1996 | Pettit et al. | 463/16 |
| 5,570,885 | 11/1996 | Ornstein . | |
| 5,741,183 | 4/1998 | Acres et al. | 463/16 |
| 5,758,875 | 6/1998 | Giacalone, Jr. | 463/20 |
| 5,770,533 | 6/1998 | Franchi | 463/16 |
| 5,816,917 | 10/1998 | Kelmer et al. | 463/16 |

OTHER PUBLICATIONS

Lauren Ritchie, "Orange Man Sought In Betting Probe", Orlando Sentinel Tribune, May 30, 1990 at p. B2.

Michael Mayo, "Win–Or–Lose Cruise; You Can Bet Sports Legally Around Here —Just Wait Till The Boat Is 3 Miles Out", Sun–Sentinel, Dec. 28, 1994 at p. 1C.

Kathy Cave, "The Lake Effect", Milwaukee Journal Sentinel, Mar. 27, 1996 at p. 8.

"Electronic Bingo System", Network Gaming International Corporation, (http://network.bingo.com/bingo.htm), download date: Nov. 13,1996.

*Primary Examiner*—Valencia Martin-Wallace
*Assistant Examiner*—John Paradiso
*Attorney, Agent, or Firm*—Dean Alderucci; Steve M. Santisi

[57] ABSTRACT

A method and device for automated, repetitive play of a gaming device, such as a slot machine. A player enters player identifying information and player parameter selections at a gaming device. The gaming device stores the player parameter selections and proceeds to initiate automated play of the gaming device. Such automated play occurs while the gaming device is unattended by the player, while a remote communications device, such as a pager, transmits certain results to the player. Furthermore, no other player may use the gaming device during such automated play. The automated play session ends upon occurrence of a limiting criterion such as the expiration of funds, or upon the manual termination of the automated play session by an external action.

62 Claims, 10 Drawing Sheets

446

| PLAYER ID 4460 | MACHINE ID NUMBER 4461 | LOCK START TIME 4462 | LOCK END TIME 4463 | MAXIMUM NUMBER OF PULLS 4464 | LIMITING CREDIT BALANCE 4465 | LIMITED MAXIMUM PAYOUT 4466 | BET PER PULL 4467 | TIME BETWEEN PULLS 4468 | COMM. DEVICE NUMBER 4469 |
|---|---|---|---|---|---|---|---|---|---|
| | | | | | | | | | |
| | | | | | | | | | |
| | | | | | | | | | |

FIG. 5

448

| COMMUNICATION DEVICE NUMBER 4480 | COMMUNICATOR IDENTIFIER 4481 | PLAYER ID 4482 | COMMUNICATION TIME OUT 4483 | COMMUNICATION TIME IN 4484 |
|---|---|---|---|---|
| | | | | |
| | | | | |
| | | | | |

FIG. 6

AUTOMATED PLAY GAMING DEVICE

BACKGROUND OF THE INVENTION

1. Field of the Invention

The present invention relates generally to a method and apparatus for initiating and terminating automatic operation of a gaming device, such as a slot machine.

2. Description of Related Art

There are numerous types of gaming devices in use today. Most of these gaming devices, such as slot machines, video blackjack machines, video poker devices, and the like, require the player of the device to be physically present during game play. Specifically, the player must be present to continuously feed money into the gaming device, initiate each play of the device, and receive any payout from the device. The requirement of a physical presence is not only a hardship on a player, as will be further described below, but also results in substantial down-time to the casino owner of the gaming device. While casinos typically have a large capital investment in gaming devices, and particularly slot machines, these devices go unused a large portion of the time. For example, late at night, between successive players, and during inclement weather, are times when such devices may go largely unused.

For a player, a constant presence at a gaming device may comprise both a physical and emotional hardship. For example, a player may wish to leave the gaming device momentarily to have dinner or take a short rest before returning to the machine. In other instances, the player may wish to leave for an extended period to attend a show, play a round of golf, or the like.

Despite wanting to leave the gaming device, the player often will desire to continue playing. Because a player's stay at a casino is limited, a player will often want to maximize the playing time, thereby increasing the chances of winning. Moreover, a player often desires to continue playing the same gaming device because the player believes that the chances of winning on that particular device are great. In gaming vernacular, the device is "due to hit."

In response to a desire to physically leave a gaming device yet continue playing it, players have been known to manually "lock-up" a device. Such manual locking-up of a device has typically been achieved by placing a "reserved" sign on the device or, in the case of slot machines, placing a change cup on the pull handle. In theory, by manually locking-up a device, a player prevents others from playing that device until the player returns to resume play.

In practice, however, manually locking-up a gaming device has several disadvantages. Manually locking-up a device is ineffectual as there can be no guarantee that other players will respect the indication that the device is locked-up. Despite the "reserved" sign or the change cup on the handle, another player may still operate the manually locked-up device. During such an apparent lock-up, the device is really reserved, not physically secured. Even if no other player begins play on the locked-up device, the time away from the device is lost; not only has the player lost opportunities to hit a jackpot, but also the owner of the device has lost significant revenue by allowing the device to go unused. Thus, there is a need for a method and system for automated play of a gaming device, thereby effectively locking-up the device in a continuous gambling mode while the player is away from the device.

The game of Keno resembles automated play. A game of Keno consists of matching a series of player-selected numbers against a series of numbers drawn by the Keno system. Once the player has selected the series of numbers, the player selects a certain number of games for which those numbers are valid. Thus, by selecting several games, the player may bet on future games without further interaction with the system.

Despite proceeding without interaction between the player and the Keno system, there is no true automated play and no device lock-up in Keno. The numbers are drawn by the system and broadcast or transmitted to a number of screens throughout an establishment, such as a casino. An unlimited number of players can attempt to match the numbers drawn. Thus, each screen displaying the numbers drawn by the system need not be locked-up. Moreover, the system continues to draw numbers regardless of whether a player is at a screen watching the numbers being drawn. In other words, each game is not initiated by a single player. Furthermore, the Keno games continue indefinitely, without regard to a particular player's status or participation and without regard to the outcome of a prior game. Thus, while the number drawings in Keno may occur in a continuous manner, there is no automated play of a dedicated machine for a selected customer.

Accordingly, the need for a method and system for automated play of a gaming device remains unsatisfied, even in a Keno environment.

SUMMARY OF THE INVENTION

In accordance with the present invention, there is provided a method and apparatus for automated play which permits a casino to recognize substantially increased play time, and hence revenue, from a gaming device. At the same time, the invention satisfies a player's emotional desire to maximize his playing time on selected gaming devices, while accommodating the physical need to at times be away from the machines.

A method according to one embodiment of the present invention satisfies this need by receiving a limiting criterion of play, initiating automated play of a gaming device, and terminating automated play of the gaming device upon occurrence of the limiting criterion. In another embodiment of the present invention, the automated play of the gaming device includes repetitive play of the device.

In many instances, the limiting criteria will be the use of the moneys initially authorized for play—i.e., the gaming device, operating in the automated play mode, runs out of money. The present invention further provides a method and apparatus for notifying a player when available credit is running low, permitting a player to visit and place more money in the machine, or to remotely authorize further funds for continued play.

A method according to another embodiment of the present invention includes the steps of communicating a player parameter selection to a gaming device and initiating automated play of the gaming device. In such an embodiment, automated play of the gaming device occurs when the gaming device is unattended by a player.

According to another embodiment, the method includes the steps of receiving a play option and automatically playing a gaming device according to the play option.

The present invention also includes a gaming device which includes a memory device having a player parameter selection stored therein and a processor in communication with the memory device. The processor is configured to initiate automated play of the gaming device until occurrence of a limiting criterion of play.

BRIEF DESCRIPTION OF THE DRAWINGS

FIG. 5 is a schematic view of the automated session database of FIG. 3;

FIG. 6 is a schematic view of the communication device database of FIG. 3;

DETAILED DESCRIPTION OF PREFERRED EMBODIMENTS

The present invention is directed generally to automated play of a gaming device. A player enters player identifying information and player parameter selections at a gaming device. The gaming device stores the player parameter selections and proceeds to initiate automated play of the gaming device. Such automated play occurs while the gaming device is unattended by the player. Furthermore, no other player may use the gaming device during such automated play. Remote communications with the player permit the player both to enjoy the ongoing play, and to alter any pre-established, limiting criteria, for example relating to funding, by returning to the machine and making appropriate adjustments. Some limitations may also be altered remotely, through a telephone call or appropriate communication to casino personnel. The automated play session ends upon occurrence of a limiting criterion or upon the manual termination of the automated play session by the player.

Certain preferred embodiments of the present invention will now be described in greater detail with reference to the drawings. Although the embodiments discussed herein are directed to reel slot machines, it should be understood that the present invention is equally applicable to other gaming devices, such as video poker machines, video blackjack machines, and the like.

Figure 1:
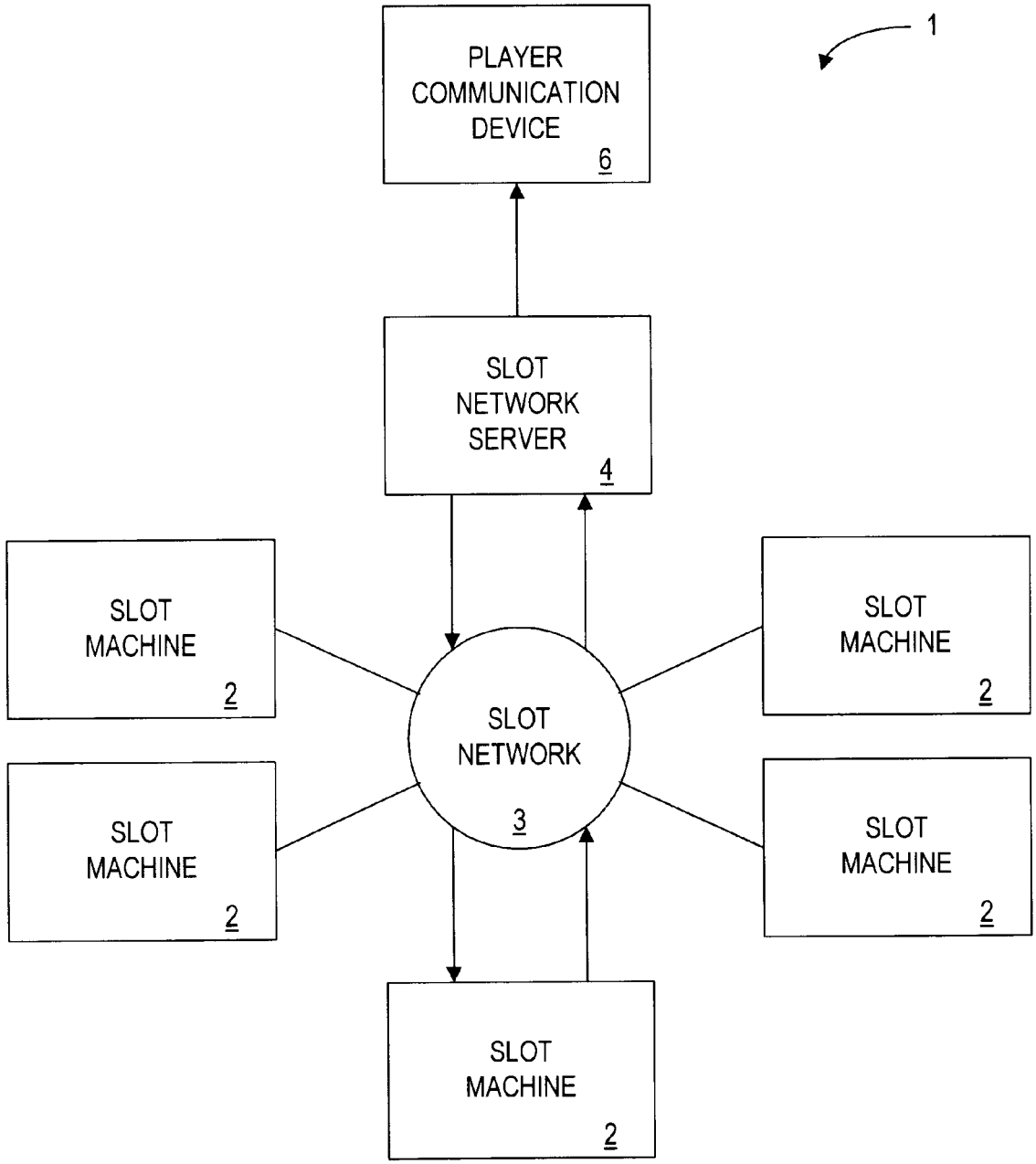
FIG. 1 is an overall schematic view of a system according to one embodiment of the present invention, including a slot machine, a slot network server, and a player communication device.

With reference to FIG. 1, a system 1 according to one embodiment of the present invention is shown. In general, the system 1 comprises multiple slot machines 2, a slot network server 4, and a player communication device 6, such as a pager or cellular telephone. In the present embodiment, each slot machine 2, which is uniquely identified by a machine identification (ID) number, communicates with the slot network server 4 via a slot network 3. The slot network 3 is preferably a conventional local area network controlled by the server 4. It is to be understood, however, that other arrangements in which the slot machines 2 communicate with the server 4 are within the scope of the present invention.

As will be described in greater detail below, the slot machine 2 communicates player identifying information and player parameter selections to the slot network server 4. The slot network server 4, in turn, communicates locking data to the slot machine 2. Additionally, the slot machine 2 generates machine messages and outcome data. The slot machine 2 communicates the machine messages and outcome data to the slot network server 4, which, in turn, communicates the information to the player communication device 6. Communications device 6, for example a pager including a display, provides sufficient information to permit the player to follow and enjoy the play, and in some cases to authorize necessary or desired changes in the play.

Figure 2:
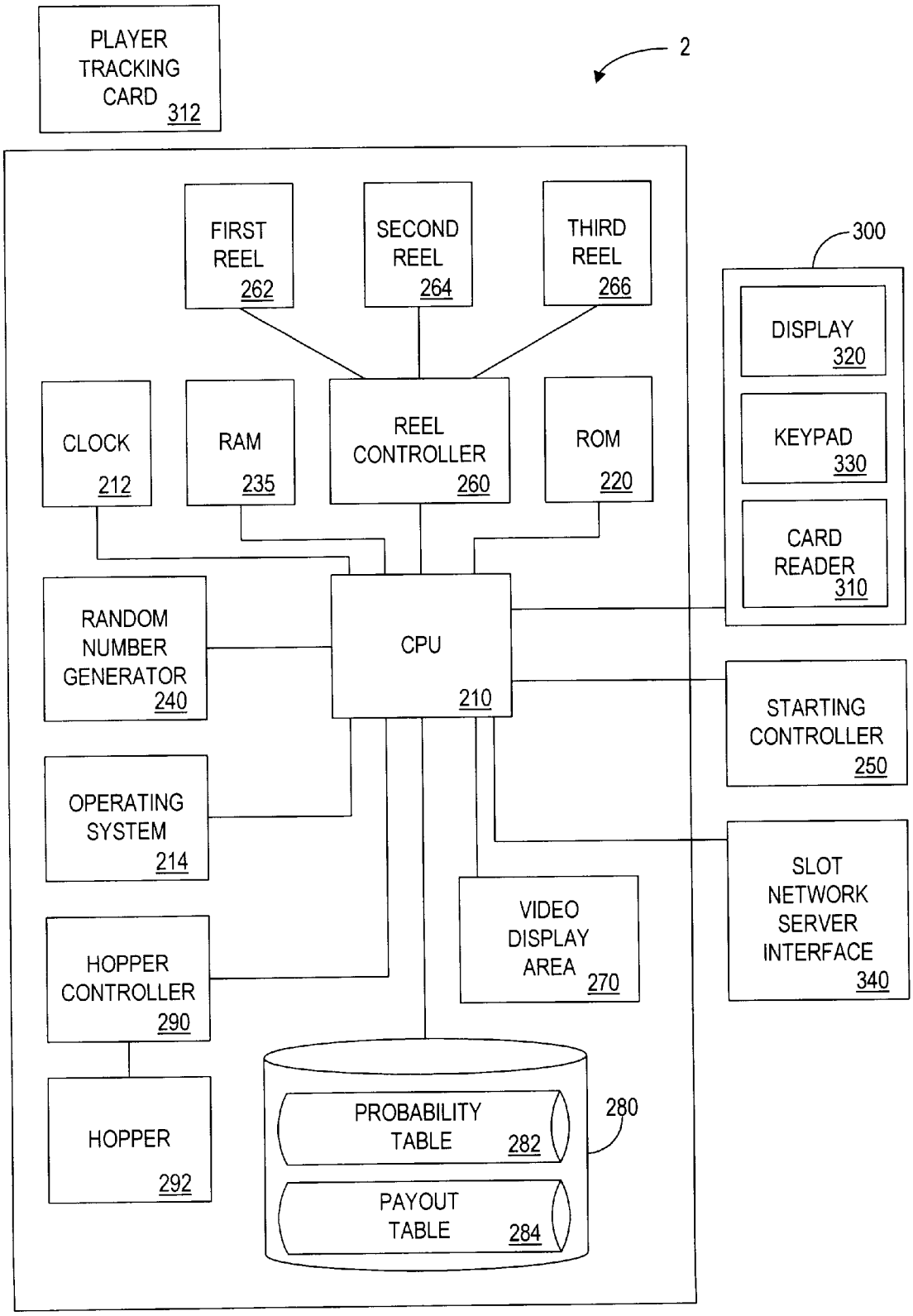
FIG. 2 is a schematic view of the slot machine of FIG. 1.

With reference to FIG. 2, the slot machine 2 will now be described in greater detail. The slot machine 2 contains a Central Processing Unit (CPU) 210, a clock 212, and an operating system 214 (typically stored in memory as software). The CPU 210 executes instructions of a program stored in Read Only Memory (ROM) 220 for playing the slot machine 2. The Random Access Memory (RAM) 235 temporarily stores information passed to it by the CPU 210 during play. Also in communication with the CPU 210 is a Random Number Generator (RNG) 240.

With respect to gaming operations, the slot machine 2 operates in a conventional manner. The player starts the machine 2 by inserting a coin, or using electronic credit, and pressing the starting controller 250. Under control of a program stored, for example in a storage device 280 or ROM 220, the CPU 210 initiates the RNG 240 to generate a number. The CPU 210 looks up the generated random number in a stored probability table 282 and finds the corresponding outcome. Based on the identified outcome, the CPU 210 locates the appropriate payout in a stored payout table 284. The CPU 210 also directs a reel controller 260 to spin reels 262, 264, 266 and to stop them at a point when they display a combination of symbols corresponding to the selected payout. When the player wins, the machine stores the credits in RAM 235 and displays them in video display area 270.

A hopper controller 290 is connected to a hopper 292 for dispensing coins. When the player requests to cash out by pushing a button on the slot machine 2, the CPU 210 checks the RAM 235 to see if the player has any credit and, if so, signals the hopper controller 290 to release an appropriate number of coins into a payout tray (not shown).

In alternative embodiments, the slot machine 2 does not include the reel controller 260 and reels 262, 264 266. Instead, a video display area 270 graphically displays representations of objects contained in the selected game, such as graphical reels or playing cards. These representations are preferably animated to display playing of the selected game.

Also in communication with the CPU 210 is a player tracking device 300. The tracking device 300 comprises a card reader 310 for reading player identification information stored on player tracking card 312. As used herein, the term player identifying information denotes any information or compilation of information that uniquely identifies a player. In the present embodiment, the identifying information is a player identification (ID) number and player name. Although not so limited, the player tracking card 312 of the present embodiment stores the player ID and player name on a magnetic strip located thereon. Such a magnetic strip and device to read the information stored on the magnetic strip are well-known.

The player tracking device 300 also includes a display 320, having a touch screen, or a keypad 330. In operation, as discussed below, the slot machine 2 may display a message prompting the player to enter player parameter selections. In the present embodiment, a player enters the player parameter selections via the display 320 which includes a touch screen. In an alternative embodiment, the player enters the player parameter selections via a keypad 330, which is part of the tracking device 300 and, therefore, in communication with the CPU 210.

Also connected to the CPU 210 is a slot network server interface 340. The network server interface 340 provides a communication path from the slot machine 2 to the slot network 3, to the slot network server 4. Thus, as discussed in greater detail below, information is communicated among the player tracking card 312, player tracking device 300, slot machine 2, and slot network server 4.

Figure 3:
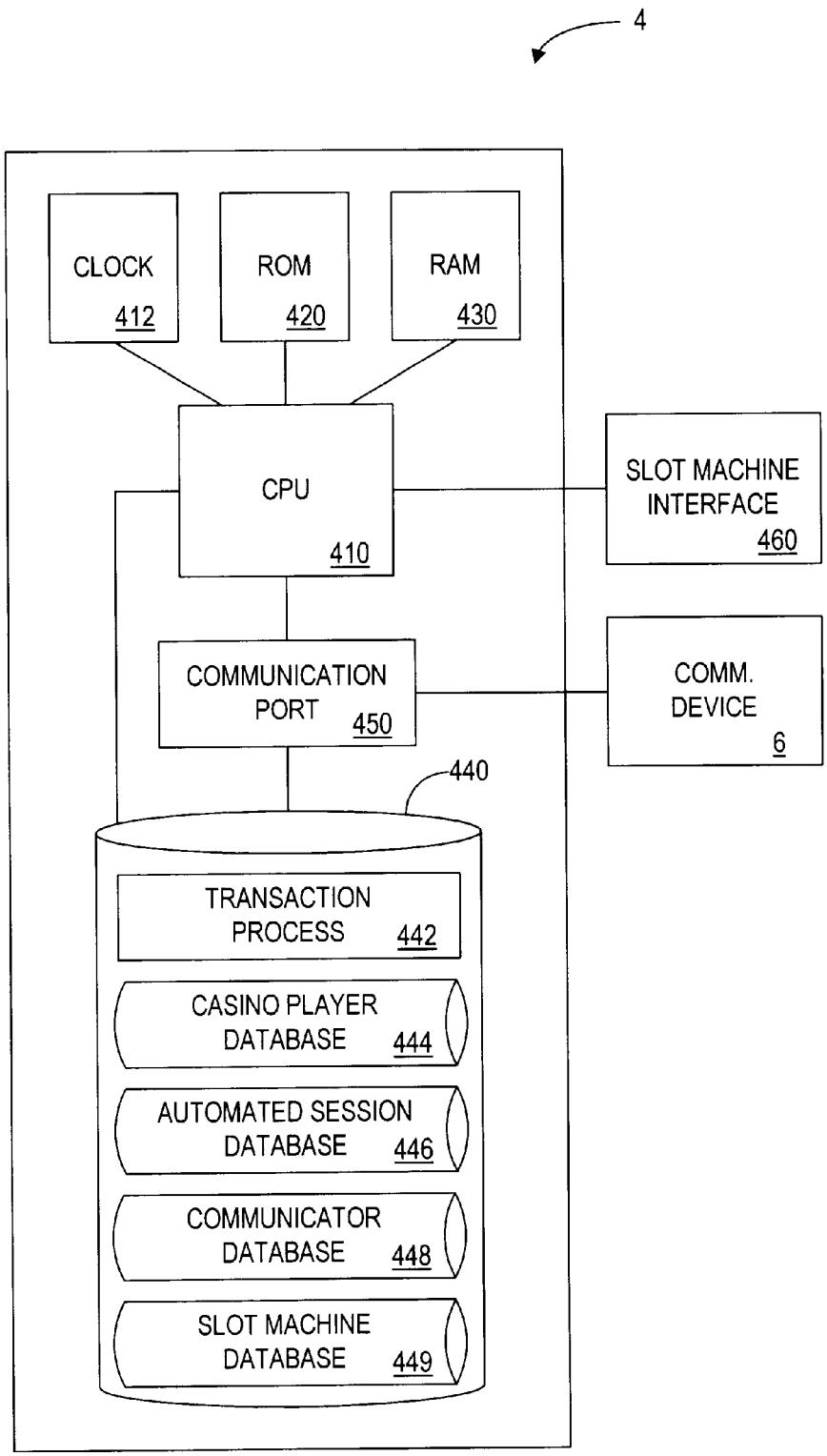
FIG. 3 is a schematic view of the slot network server of FIG. 1, including a player database, automated session database, communication device database, and slot machine database.

With reference to FIG. 3, the slot network server 4 will be described in greater detail. Like the slot machine 2 of FIG. 2, the slot network server 4 has a Central Processing Unit (CPU) 410. The CPU 410, which has a clock 412 associated therewith, executes instructions of a program stored in Read Only Memory (ROM) 420. During execution of the program instructions, the CPU 410 temporarily stores information in the Random Access Memory (RAM) 430.

Additionally, the CPU 410 is coupled to a data storage device 440, having a transaction processor 442, a casino player database 444, an automated session database 446, a communication device database 448, and a slot machine database 449. In general, the transaction processor 442 manages the contents of the data storage devices 440. As discussed in detail below, the player database 444, automated session database 446, the communication device database 448, and slot machine database 449 store information related to player identification, automated operation of the slot machine 2, remote communication to the player's communication device 6, and slot machine outcomes, respectively.

In order to communicate with the communication device 6, the slot network sever 4 also includes a communication port 450. The communication port 450 is coupled to both the CPU 410 and the data storage device 440. Thus, the CPU 410 can control the communication port 450 to receive information from the data storage device 440 and transmit the information to the communication device 6. Despite being shown as a solid line, the communication path between the communication port 450 and the communication device 6 is preferably not hardwired. As noted above, the communication device 6 is preferably a pager or cellular telephone, thereby involving wireless communication.

Lastly, the slot network server 4 includes a slot machine interface 460 coupled to the CPU 410. The slot machine interface 460 allows the slot network server 4 to communicate with the slot machines 2 coupled to the network.

Figure 4:
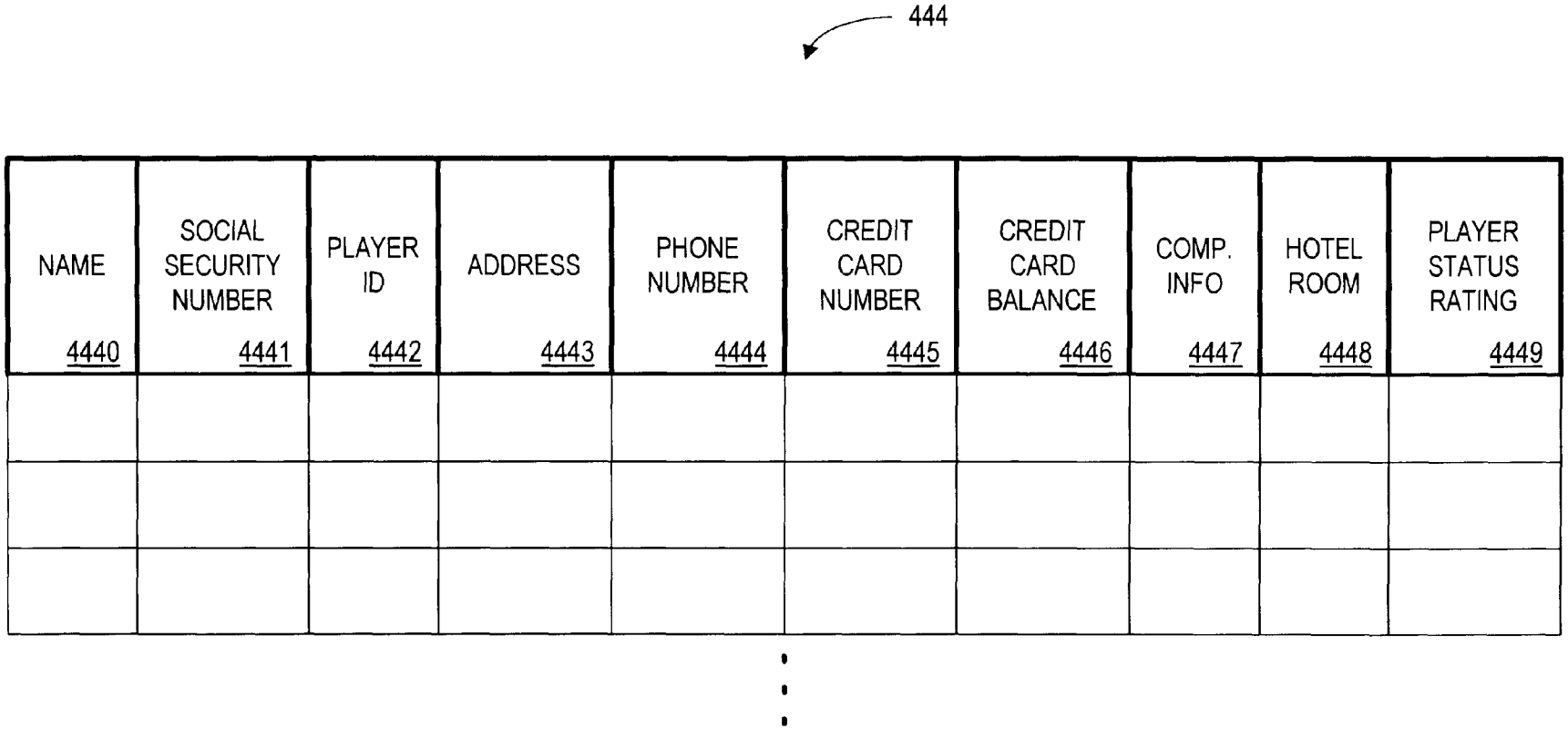
FIG. 4 is a schematic view of a player database of FIG. 3.

The player database 444 of the present embodiment as shown in FIG. 4, includes multiple records having multiple fields of information. Specifically, the player database 444 comprises multiple records, each record being associated with a particular player, as identified by a player identification (ID) code. The fields within each record include: name 4440, social security number 4441, player ID 4442, address 4443, telephone number 4444, credit card number 4445, credit balance 4446, complimentary information, such as complimentary points awarded 4447, hotel room number 4448, and player status rating 4449. Thus, having information related to one field, such as player ID 4442, allows the slot network server 4 to retrieve all information stored in the other fields of that player's record.

It is to be understood that not all of these identifying fields are necessary for operation of the present embodiment. Specifically, the name 4440, social security number 4441, player ID 4442, address 4443, telephone number 4444, credit card number 4445, and hotel room 4448 fields are merely representative of additional information that may be stored and used for other purposes. For example, in an alternative embodiment, credit card number 4445 and hotel room number 4448 are used for billing purposes and social security number 4441 is used to generate tax forms when a player wins a jackpot over a given amount.

Complimentary points awarded 4447 and player status rating 4449 are further illustrative of additional information a casino may store in a player's record. Thus, in the present embodiment, only the player's name 4440, player ID 4442, and credit balance 4446 are necessary.

The automated session database 446, as shown in FIG. 5, comprises multiple records, each record pertaining to the automated play session of a particular player, as identified by the player ID. Consequently, one field in each record is the player ID field 4460. Other fields include: machine identification (ID) number 4461, lock start time 4462, lock end time 4463, maximum number of pulls 4464, limiting credit balance 4465, limiting maximum payout 4466, bet per pull 4467, time between pulls 4468, and communication device number 4469. As will be apparent to one of ordinary skill in the art, since both the player database 444 and the automated session database 446 include a player ID field, 4440 and 4460, respectively, the system 1 can correlate any information stored in the player database 444, corresponding to a particular player, with any information stored in the automated session database 446, corresponding to that same player.

The communication device database 448, as shown in FIG. 6, includes multiple records, each record pertaining to a different communication device 6 as identified by a communication device number as stored in the communication device number field 4480. The additional fields in each record include: communicator identifier 4481, player ID 4482, communicator time out 4483, and communicator time in 4484. Because the communication device database 448 and the automated session database 446 both include a communication device number field 4481, 4468, respectively, information can be correlated between the two databases. Furthermore, because the communication device database 448, like the automated session database 446 and the player database 444, contains a player ID field 4482, the system 1 can correlate information contained within these three databases 444, 446, 448 for a particular player, as identified by the player ID.

In one embodiment of the present invention, the information stored in the communication device database 448 is used to inventory the communication devices 6. The communication time out 4483 represents the time at which a player removed a communication device 6 from a slot machine 2 and the communicator time in 4484 represents the time the communication device 6 was returned to the slot machine 2. Having such information, the slot network server 4 may, at any given time, search the communication device database 448 and determine which communication devices 6 are presently in use. Furthermore, for any communication device 6 that has been out for more than a given period, the server 4 knows which player, based upon the player ID number in field 4482, last used the device 6. Moreover, based on the player ID number, the server 4 can obtain the information necessary to contact that from that player's record in the player database 444.

As will be understood by those skilled in the art, the ultimate goal of most slot machine players is to hit a jackpot payout. The enjoyment of the play, as well as the ability to maximize the chance of hitting a large jackpot, is increased by more play. Play can be increased both by playing longer, and by playing faster. As will be appreciated from a consideration of the process described below, the present invention permits both increased duration and speed of play.

Figure 7:
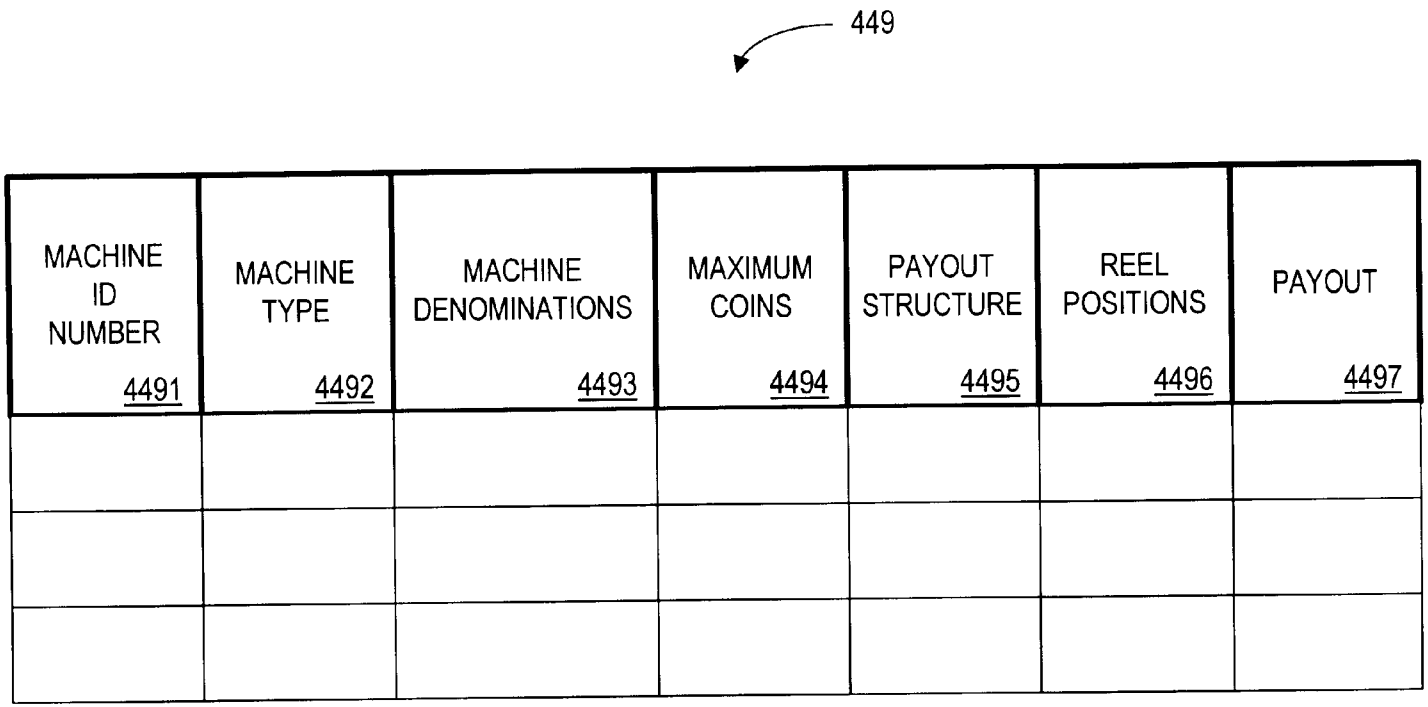
FIG. 7 is a schematic view of the slot machine database of FIG. 3.

The slot machine database 449, as shown in FIG. 7, relates to information concerning each slot machine 2. As illustrated, each slot machine 2 has an associated record in the database. Each slot machine 2 is identified by a unique machine ID number, as stored in the machine ID number field 4491. The other fields in the slot machine database 449 include: machine type 4492, machine denomination 4493, maximum coins allowed 4494, payout structure 4495, reel positions 4496, and payout 4497. Because the slot network server 4 may search any field in the slot machine database 449, the server 4 is able to identify a slot machine 2, not only by its machine ID number 4491, but also by the type 4492 and denomination 4493 of the slot machine 2.

Figure 8A:
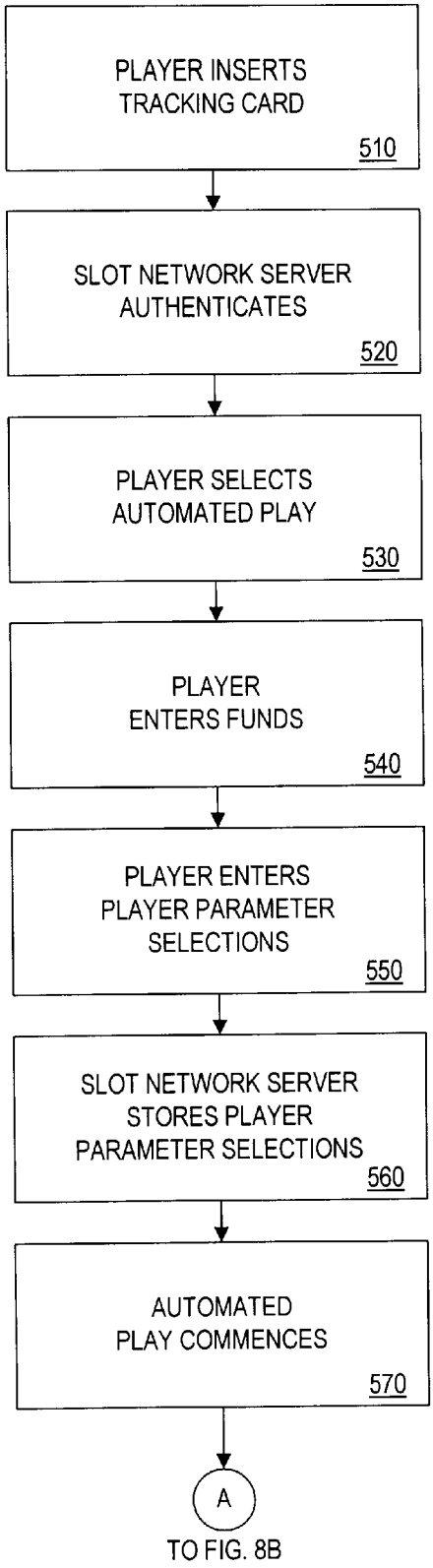
FIGS. 8*a* and 8*b* show an overall flow diagram of the operation of the system of FIG. 1.
Figure 8B:
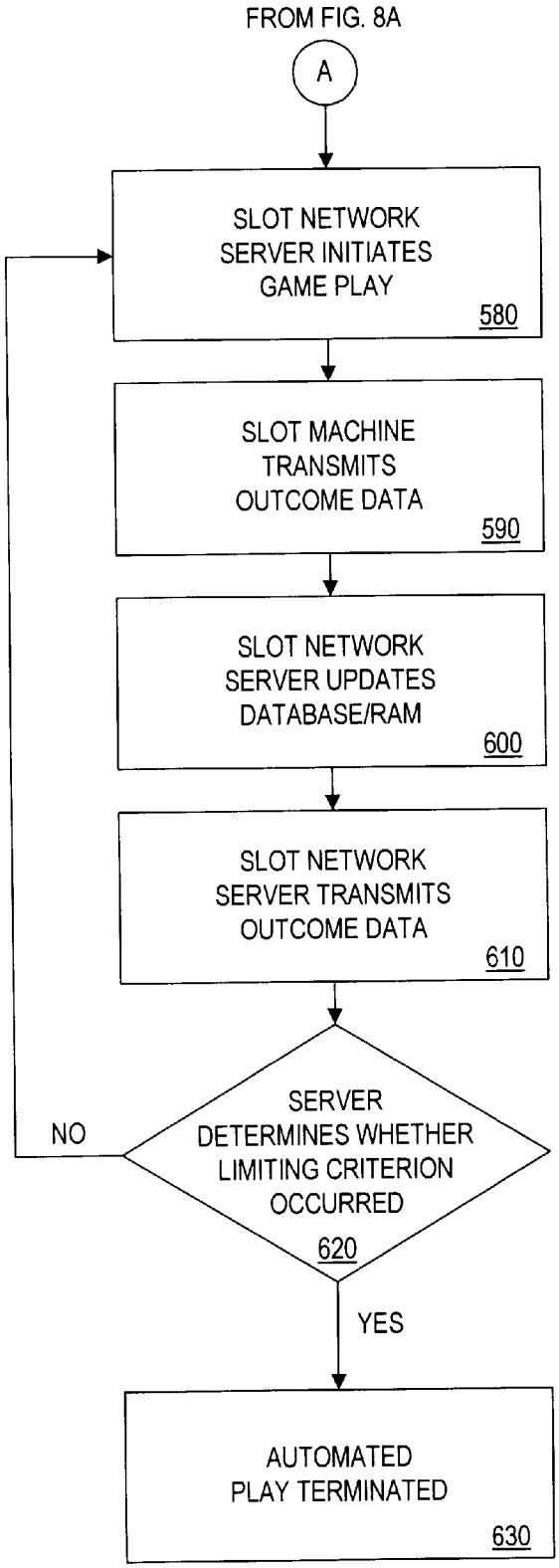

Having thus described the components of the present embodiment, the operation of the system 1 will now be described in greater detail with reference to FIGS. 8*a* and 8*b*, and continuing reference to FIGS. 1–7. It is to be understood that the programs stored in ROM 420 of the slot network server 4 and ROM 220 of the slot machine 2 provide the function described below.

As shown as step 510, the slot machine player first inserts the player tracking card 312 into the card reader 310. The card reader 310 then proceeds to read player identifier information from the tracking card 312. The player identifier information, namely the player's name and the player ID, are communicated from the slot machine 2 to the slot server 4. Upon receiving the player identifying information, the slot network server 4 authenticates the information. This step, depicted as step 520, includes the slot network server 4 searching the player database 444 for a record containing the player name and player ID received in the appropriate field 4440, 4442, respectively. Once the slot network server 4 authenticates the player identifying information, the server 4 transmits a signal to the slot machine 2 acknowledging such authentication.

In step 530, the player chooses to select automated slot machine play. The slot machine 2 also prompts the player to enter funds for use during the automated play. Specifically, as shown in step 540, the player enters coins into the slot machine 2. The slot machine 2 registers the total amount of money deposited by the player. The slot machine 2 then transmits a signal to the slot network server 4 indicating the amount of funds deposited by the play. In response, the slot network server 4 accesses the record in the player database 444 corresponding to the particular player and increments the credit balance field 4446 by the amount of funds deposited.

In the alternative, gaming credits accumulated during non-automated play of the slot machine 2 may be used to fund the automated play session. The slot machine 2, which locally stores the gaming credits in memory, transmits the amount of credits to the slot network server 4 for addition to the credit balance 4464.

In yet another alternative embodiment, the player, prior to initiating automated play, produces the player tracking card 312 at a slot change booth or casino cage and deposits a certain amount of funds. The casino personal reads the player ID number from the player's tracking card 312 with a card reader and proceeds to access the record in the player database 444 corresponding to that player ID. The cashier then increments the credit balance field 4446 by the amount of funds just deposited.

In step 550 the remote player enters the player parameter selections. More specifically, the slot network server 4 transmits a signal to the slot machine 2 causing the slot machine 2 to display a prompt on the display 320 requesting that the player enter the player parameter selections. As noted above, the player preferably enters the player parameter selections via the touch screen on the display 320. In an alternative embodiment, the player enters the player parameter selection via keypad 330. In yet another alternative embodiment, the player parameter selections are previously stored in a record in the automated session database 446 as identified by the particular player's player ID in field 4460.

Player parameter selections include both play options and limiting criteria of play. Play options, as used herein, include any information used to define automated play. In the present embodiment, play options include the bet per game or handle pull and time between games or handle pulls, as stored in fields 4467 and 4468 of the automated session database 446. A limiting criterion, on the other hand, is any information that may define the beginning or end of an automated play session. In the present embodiment, limiting criteria include: lock start time, lock end time, requested number of games or handle pulls, credit balance, total losses, total winnings, and limiting maximum payout. By definition, the expiration of all available credits/funding for playing the machine will, unless other arrangements are made in advance with the casino, constitute a limiting criteria of play. Similarly, the player may define a specific winning credit value as a limiting criteria of play, e.g. stop playing if a credit of one thousand dollars is ever registered.

Once the slot machine 2 receives the player preference selections, the slot machine 2 transmits the information to slot network server 4. The slot network server 4, as shown in step 560, proceeds to store the player parameter selections in the appropriate fields in the automated session database 446.

In addition to storing the player parameter selections, the slot network server 4 assigns an address in RAM 430 to keep current totals of actual limiting values. An actual limiting value is a value that corresponds to a limiting criterion of play. More specifically, an actual limiting value is the actual, current total of a criterion value necessary to determine whether any of the limiting criteria of play have occurred.

Thus, in the present embodiment, the slot network server 4 assigns an address in RAM 430 to store the number of games or handle pulls that actually occur during automated play. Additionally, the server 4 assigns an address in RAM 430 to store the actual amount of losses or winnings during automated play. Both the actual number of handle pulls and the actual amount of winnings or losses are actual limiting values. The server 4 also assigns an address in RAM 430 to store an actual limiting value corresponding to the time between handle pulls 4468. Furthermore, the current credit balance, which is stored in RAM 430 is also an actual limiting value. As described below with reference to steps 590, 600 and 620, these actual limiting values are updated during automated play and used to determine whether a limiting criterion has occurred.

Next, in step 570, automated play commences. Commencement of automated play includes the slot network server 4 transmitting locking data to the slot machine 2. The locking data is a signal that prevents the slot machine 2 from accepting coins and entering manual mode unless automated play is terminated by the player that initiated it.

Automated play may commence in at least two different ways. The server 4 may initiate automated play of the game, as shown in step 580, if the player has entered a lock start time 4463 as a player parameter selection. Specifically, the slot network server 4 searches the automated session database 446 and compares the time from the clock 412 to the values stored in the lock start time field 4463 and the lock end time 4464. If the internal clock time is equal to or greater than the value stored in the lock start time field 4463 and less than the value stored in the lock end time field 4464 (if such a value exists), then the slot network server 4 transmits a signal to the slot machine 2 to initiate play.

Alternatively, the player may choose to begin automated play immediately upon entering the player parameter selections other than a lock start time 4462. Regardless of the manner in which automated play commences, the slot machine 2 proceeds to operate as described above with reference to FIG. 2 and generates outcome data.

In step 590, the slot machine 2, having played a game and generated outcome data, transmits the outcome data to the slot network server 4. Along with the outcome data, the slot machine 2 transmits its machine ID number so that the server 4 can identify from which machine the outcome data came.

Output data, as used herein, means any information describing the outcome of a game or handle pull. In the present embodiment, outcome data includes the final position of each reel and the corresponding payout or loss for a given play.

Once the slot network server 4 receives the outcome data, it updates the player database 444 and the slot machine database 449 in step 600. More specifically, the slot network server 4 accesses the slot machine database 449 and updates the record pertaining to the particular slot machine 2, as identified by its machine ID number 4491. The slot network server 4 also accesses the automated session database 446 to determine the bet per pull 4466 for the particular player. Lastly, the slot network server 4 accesses the player database 444 to update the credit balance field 4446 in the player's record. The credit balance field 4446 is decreased by the bet per pull amount and increased by the payout 4497, if any.

Once the slot network server 4 receives the outcome data, the server 4 also updates the actual limiting criteria stored in RAM 430, as needed. Specifically, the number of pulls value is incremented by one and the total losses/winnings value is changed to reflect the results of the last game. The server 4 also stores the time it proceeds to step 610, as indicated by clock 412, as the actual limiting value corresponding to the time between handle pulls 4468 ("the actual limiting time value").

The server 4 uses the actual limiting time value to determine the speed of play. Each subsequent time the system 1 performs the operations of step 600, the server 4 also determines whether, in light of the time between handle pulls 4468 limiting criterion, it must delay before continuing to proceed. Specifically, the server 4 retrieves the time between handle pulls 4468 and the previously stored actual limiting time value. The server only proceeds to step 610 when the current time, as indicated by the clock 412, equals the sum of the time between handle pulls 4468 and the previously stored actual limiting time value. The server 4 stores the time it proceeds to step 610 as the new actual limiting time value.

It is anticipated that a player having only a limited time remaining at a casino and a small amount of funds available will enter "zero" as the time between handle pulls 4468. If such a value is received, the system 1 proceeds to continuously generate outcome data without delay until a limiting criterion of play occurs. The player enters zero as the time between handle pulls 4468 in step 550 and likely remains at the slot machine 2 to watch the slot machine 2 rapidly play game after game until the player is out of funds or wins a jackpot.

Once the slot network server 4 receives the outcome data and updates the databases, the server 4 transmits the results of the play to the remote player communication device 6. The results communicated in step 610 to the player communication device 6 may include the actual reel position 4496, the payout of a particular game 4496, the player's current credit balance 4446, and any other information stored or generated by the system 1.

The slot network server 4 establishes communication with a communication device 6 that is associated with the particular player. Specifically, the server 4 accesses the communication device database 448 and searches for the communication device number 4480 equal to that stored in the player's record in the automated session database 446 in field 4469. The server 4 then uses the communication identifier 4481, which is the pager or cellular telephone number, to establish communication with the communication device 6.

As described above, in one embodiment of the invention communication device 6 comprises a pager with a liquid crystal or other type of display. This communication of the outcome data to the player, which may even include a display of the reel position outcome on the display, permits a player to enjoy the excitement of the play without a physical presence at the device. Further, such essentially real-time communication with the slot machine permits a player to adjust the limiting criteria to maximize enjoyment and potential return, typically by increasing the speed and duration of play.

In one embodiment aspect of the invention, the remaining credit balance is communicated to the player along with the outcome data. Thus, when a player notes that his play may be terminated because the machine is running out of money, he has the opportunity to increase the credit balance. Preferably, the player will return to the slot machine and add further moneys. If returning to the slot machine is not convenient, the player can increase the credit balance by phoning the casino and authorizing the casino personnel to increase the credit balance on the machine. The casino personnel will appropriately enter the additional funds into the correct server database fields. If returning to the slot machine is convenient, the player may choose simply to return to the machine and add more coins.

In step 620, having just completed one play, the slot network server 4 determines whether a limiting criterion has occurred. Specifically, in the present embodiment, the slot network server 4 accesses the record in the automated session database 446, as identified by the player's ID 4460, to determine whether any one of the limiting criteria have occurred.

The determination of whether any of the limiting criteria have occurred is made by comparing 1) the lock end time 4464 to an internal clock of the server 4; 2) the maximum number of pulls 4464 to the actual number of pulls stored in RAM 430; 3) the current credit balance 4446 to the limiting credit balance 4465; and 4) the limiting maximum payout 4466 to the actual payout 4497. If none of the limiting criteria have occurred, operation of the system 1 proceeds from step 580, once again.

If any one of the limiting criteria has occurred, then, in step 630, the slot network server 4 stops the automated play session and transmits a signal to the communication device 6, thereby notifying the player that the automated session has ended. The machine 2 remains locked-up until the player returns. In an alternative embodiment, the slot network server 4 also transmits an unlocking signal to the slot machine 2 upon the occurrence of a limiting criterion of play. The unlocking signal indicates to the slot machine 2 that it may accept coins and allow other players to commence play.

In yet another embodiment, information other than outcome data, such as machine messages, is communicated to the communication device 6. Machine messages, as used herein, include information generated by the slot machine 2 relating to the status of that particular slot machine 2. For example, such a machine message may indicate that the slot machine 2 is jammed.

In yet another embodiment of the present invention, limiting criteria of play, actual limiting values, or both, are communicated to the player. For example, the player will be notified of the current credit balance 4446 and the limiting credit balance 4465, as well as the current number of pulls, as stored in RAM 430, and the maximum number of pulls 4464 allowed.

In an alternative embodiment, the outcome data transferred in step 590 of FIG. 8 need only include the payout 4497, if any. In such an alternative embodiment, the slot machine 2 communicates only the payout information to the slot network server 4. The server 4, in turn, accesses a slot machine database 449 and, based upon the machine ID number transmitted, accesses a record for that slot machine 2. A payout structure for that particular slot machine 2 is maintained within the record. The payout structure, like the payout table 284 in the slot machine 2, correlates the payout received from slot machine 2 to a possible reel result.

For example, if reels 262, 264, 266 of the slot machine 2 reveal "cherry-cherry-bar," the slot machine 2 may determine that, according to the payout table 284, the player should receive a payout of ten coins. The slot machine 2 then communicates to the slot server 4 a payout of ten coins. The server 4, by a accessing the payout structure, correlates the payout of ten coins back into the reel positions of "cherry-cherry-bar." Because several reel positions may correspond to the same payout, the slot network server 4 may determine that a reel position other than "cherry-cherry-bar" occurred. Thus, the server 4 simulates the actual outcome of the slot machine 2 for transmission to the player's communication device 6.

It will be appreciated by those skilled in the art that, while the player may select player parameter selections in the manner described above, the casino may also set guidelines on the automated operation of the slot machines. In general, the casino is desirous of maximizing play on, and hence revenue from, each machine. Thus the casino may limit the selectable range of player parameter selections, for example the frequency of handle pulls, to insure reasonably constant and speedy play. Further, the casino may alter the range of player parameter selections, and even the fundamental operation of the machines, to encourage play during otherwise empty time. For example, casino may permit a machine to be played during late night hours, in an automated mode, at a slower speed and with a higher payout schedule. This would permit a player to start automated play during the nighttime hours when the machine would be otherwise unused. The casino hours would benefit from increased play and revenue, while the player would benefit from potentially better payouts.

Figure 9:
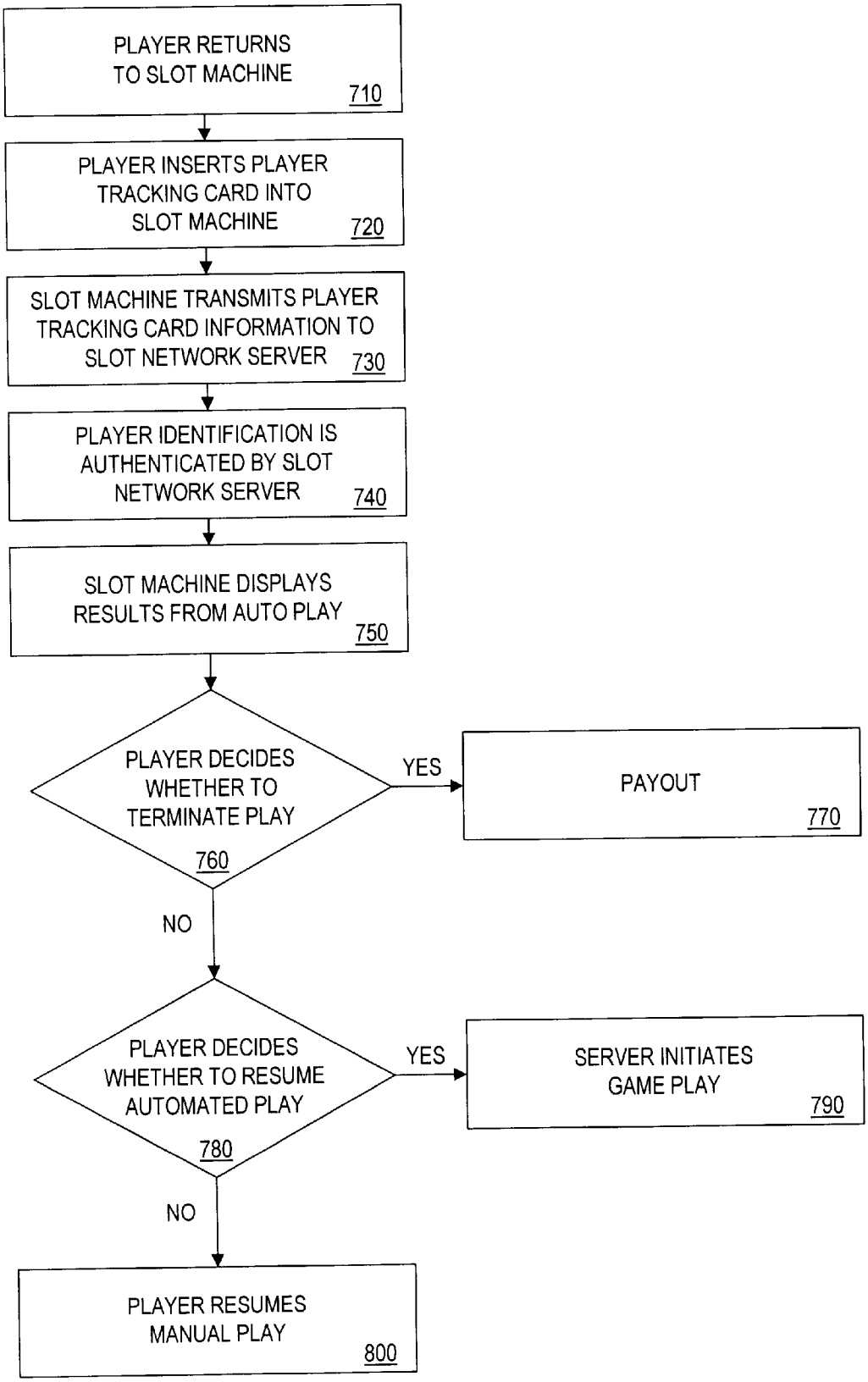
FIG. 9 is a flow diagram of the system of FIG. 1, illustrating termination of automated play.

At any time during the operation of the system 1, as described with reference to FIG. 8, the player may return to the slot machine 2 and manually terminate automated play. Such manual termination of automated play will now be described with reference to FIG. 9.

The player initially must return to the slot machine 2 as shown in step 710. Upon returning to the machine 2, the player, in step 720, inserts the player tracking card 312 into the card reader 310. The card reader 310 reads the player identifying information from the player tracking card 312 and, in step 730, the slot machine 2 transmits this player identifying information to the slot network server 4.

In step 740, the slot network server authenticates the player identifying information. Specifically, the slot network server 2 searches the automated session database 446 to determine whether the player ID number and the machine ID number just received are also present in a single record in the automated session database 446. If the information is present in a single record in the automated session database 446, the player identifying information is deemed authentic.

Having authenticated the player identifying information, the slot network server 4 transmits the results from the automated play to the slot machine 2 for display to the player in step 750. The results, which are displayed on display 320, preferably include the player's credit balance 4464. Having read the results from the automated play session, as shown as step 760, the player may then decided to terminate play of the slot machine 2. In step 770, if the player decides to terminate play, then the player may receive a payout owed.

It will be understood that, should the player so desire, a complete audit of the automated play session is available through an appropriate examination of the contents of slot machine database 449. Such an audit would typically be provided by casino personnel upon special request by the player, and could include a complete reporting of results for every play during the automated session.

On the other hand, if the player decides not to terminate play, then the player must decide whether to resume automated play, as shown in step 780. If the player decides to resume automated play, such play will continue as described with reference to FIG. 8, steps 580–630, until a limiting criterion occurs or the player returns to manually terminate play. The resumption of automated play is shown as step 790.

As an alternative to resuming automated play, the player may decide instead to resume manual play of the slot machine 2. Step 800 illustrates the resumption of manual play.

As shown in step 770, the player may receive any payout 4497 due. Receiving the payout may involve the slot machine 2 dispensing the amount of coins equal to the credit balance 4464 for the player. In an alternative embodiment, the payout involves the player returning to the slot change booth or casino cage and presenting the player tracking card 312. The casino personnel proceed to read the player ID and player name from a player tracking card 312. Upon verifying the player's identification with a secondary form of ID, such as a driver's license, the personnel access the player database 444. The casino personnel proceed to pay the player any amount less than or equal to the current credit balance 4446 stored in the player's record. The personnel then adjust the credit balance 4446 to reflect the disbursement.

It is to be understood that the present invention is not limited to an embodiment including both the slot machine 2 and the slot network server 4. Specifically, in one embodiment of the present invention, a slot machine alone stores the automated play information, including player identifying information, credit balance, player parameter selections, and actual limiting values. Moreover, the slot machine not only generates outcome data, but also, rather than employing a server, internally updates the information as described above.

Furthermore, the present invention encompasses automated play of gaming devices that require a player to make decisions during play, such as video blackjack machines, video poker machines, and the like. The inclusion of decision rules in the player parameter selections accounts for the need to make decisions. Decision rules dictate the course of play based upon the current status of play. For example, decision rules for automated play of a video blackjack machine include staying when the dealer shows a "six" and playing according to the highest odds of winning. In short, because decision rules obviate the need for player decisions, automated play may proceed.

There has thus been provided a method and apparatus of operating a gaming device, for example a slot machine, in an automated manner. The present invention permits a casino to significantly increase the usage and revenue of such gaming devices, encouraging substantially continuous play at times when the machine might otherwise be un- or under-used. The invention further permits a player to enjoy all of the benefits of gambling, such as the enjoyment of viewing real-time gaming device results, without necessitating a physical presence at the machine. Additionally, the invention permits the casino to offer better-than-normal playing parameters, such as an improved payout schedule, or even the special reservation of a selected machine during normal playing hours, to players who are willing to utilize the machines during what would normally be off hours.

Although the present invention has been described in terms of certain preferred embodiments, other embodiments that are apparent to those of ordinary skill in the art are also intended to be within the scope of the present invention. Accordingly, the scope of the present invention is intended to be limited only by the claims appended hereto.

What is claimed is:

1. A method comprising the steps of:

receiving a limiting criterion of play;

initiating automated play of a gaming device; and terminating automated play of said gaming device upon occurrence of said limiting criterion.

2. The method of claim 1 further comprising the step of communicating to said gaming device a play option; and wherein said initiating step comprises automatically operating said gaming device in accordance with said play option.

3. The method of claim 2 wherein said play option comprises an option selected from the group consisting of: bet per play and time between plays.

4. The method of claim 1 wherein said limiting criterion of play comprises a criterion selected from the group consisting of: lock end time, maximum number of plays, total payout, total losses, maximum payout, and current credit balance.

5. The method of claim 1 wherein said initiating step comprises transmitting a locking signal to said gaming device.

6. The method of claim 5 further comprising the steps of receiving outcome data; and notifying a player of said outcome data.

7. The method of claim 6 wherein said notifying step occurs upon occurrence of said limiting criterion of play.

8. The method of claim 6 wherein said step of notifying occurs at a predetermined interval.

9. The method of claim 8 wherein said predetermined interval is a predetermined time interval.

10. The method of claim 6 wherein said gaming device is a slot machine.

11. The method of claim 10 wherein said outcome data comprises a data selected from the group consisting of: reel position and amount of payout.

12. The method of claim 1 wherein said terminating step comprises terminating automated play of said gaming device upon occurrence of either said limiting criterion of play or a manual player termination signal, whichever occurs first.

13. A method comprising:

communicating a player parameter selection to a gaming device; and initiating automated play of said gaming device based on said player parameter selection.

14. The method of claim 13 wherein said communicating step comprises communicating player identifying information to said gaming device.

15. The method of claim 13 wherein said communicating step comprises inserting a player tracking card into said gaming device.

16. The method of claim 13 wherein said communicating step comprises communicating a play option.

17. The method of claim 13 wherein said communicating step comprises communicating a limiting criterion of play.

18. The method of claim 13 wherein said communicating step comprises communicating a player identification number.

19. The method of claim 13 wherein said communicating step comprises identifying a source of funds from which payment for automated play of said gaming device and to which credit for winning during automated play of said gaming device is made.

20. The method of claim 15 further comprising receiving outcome data from said gaming device.

21. The method of claim 20 wherein said receiving step comprises a step selected from the group consisting of: receiving a page on a pager, receiving a call on a telephone, receiving a call on a cellular telephone, and receiving a page through an intercom system.

22. The method of claim 20 wherein said gaming device is a slot machine and said outcome data comprises data selected from the group consisting of: reel position and payout.

23. The method of claim 15 further comprising the step of receiving an actual limiting value.

24. The method of claim 23 wherein said actual limiting value comprises a value selected from the group consisting of: current credit balance, total winnings, total losses, and actual number of plays.

25. The method of claim 13 further comprising the step of remotely receiving notification of a current credit balance.

26. The method of claim 13 further comprising the step of remotely adjusting a credit balance.

27. A method comprising the steps of:

receiving a player parameter selection; and receiving a locking signal from a server to initiate automated play of a gaming device.

28. The method of claim 27 wherein said gaming device is a slot machine.

29. The method of claim 28 further comprising the step of generating outcome data.

30. The method of claim 29 wherein said outcome data comprises a reel position.

31. The method of claim 29 further comprising the step of transmitting said outcome data to said server.

32. The method of claim 27 further comprising the step of terminating automated play of said gaming device upon receiving an unlocking signal from said server.

33. The method of claim 27 wherein said player parameter selection comprises a play option.

34. The method of claim 33 wherein said play option comprises one of the group consisting of: time between game plays and bet per game.

35. The method of claim 27 wherein said automated play comprises repetitively playing said gaming device.

36. A device comprising:

means for storing a player parameter selection;

means for initiating automated and repetitive play of a game in accordance with said player parameter selection; and means, in communication with said means for initiating automated play, for terminating automated play.

37. The device of claim 36 further comprising a means for receiving said player parameter selection, said means for receiving in communication with said means for storing.

38. The device of claim 37 wherein said player parameter selection includes a limiting criterion of play and wherein said means for terminating terminates automated play upon occurrence of said limiting criterion.

39. The device of claim 36 further comprising a means for receiving outcome data from said gaming device.

40. The device of claim 39 wherein said means for receiving is a pager.

41. The device of claim 36 wherein said means for initiating automated play comprises a means for generating a locking signal.

42. A gaming device comprising:

means for receiving a player parameter selection; and means for initiating automated play in accordance with said player parameter selection.

43. The device of claim 42 further comprising a means, in communication with said means for initiating automated play, for communicating outcome data to a server.

44. The device of claim 43 wherein the gaming device is a slot machine.

45. The device of claim 44 wherein said outcome data comprises reel position.

46. The device of claim 45 further comprising a means, in communication with said means for initiating automated play, for receiving a locking signal from said server.

47. The device of claim 42 further comprising a means, in communication with said means for initiating automated play, for terminating automated play of the gaming device upon occurrence of a limiting criterion of play.

48. A gaming device comprising:

a memory device having a player parameter selection stored therein;

a processor in communication with said memory device, said processor configured for initiating automated play of the gaming device.

49. The device of claim 48 wherein the gaming device is a slot machine.

50. The device of claim 49 wherein said player parameter selection comprises a play option.

51. The device of claim 50 wherein said processor is configured for initiating automated play of said slot machine according to said play option.

52. The device of claim 49 wherein said player parameter selection comprises a limiting criterion of play, said processor configured for initiating automated play until occurrence of said limiting criterion of play.

53. The device of claim 49 wherein said processor is configured to generate outcome data, said outcome data comprising reel position.

54. The device of claim 48 further comprising a touch screen in communication with said memory device.

55. The device of claim 48 further comprising a keypad in communication with said memory device.

56. An article of manufacture comprising:

a computer readable medium having a computer readable program code means embodied thereon, said computer readable program code means comprising means for initiating automated play of a gaming device, said means for initiating including means for generating a locking signal, and means for initiating termination of automated play upon occurrence of a limiting criterion of play.

57. An article of manufacture comprising:

a computer readable medium having a computer readable program code means embodied thereon, said computer readable program code means comprising means for interpreting a locking signal and a means for initiating automated play of a gaming device in response to said locking signal.

58. A method comprising the steps of:

initiating automated play of a gaming device; and terminating automated play of the gaming device upon occurrence of a limiting criterion specified by a player of the gaming device.

59. The method of claim 58 wherein the step of initiating is triggered by the player at a remote location relative to the gaming device.

60. The method of claim 58 wherein the step of initiating is triggered by the player specifying the limiting criterion from a remote location relative to the gaming device.

61. The method of claim 58 further including the step of providing status of the automated play of the gaming device to the player.

62. The method of claim 61 further including the step of revising the limiting criterion by the player in response to the step of providing status.

* * * * *